United States Patent [19]

Kawarabashi

[11] Patent Number: 4,660,367

[45] Date of Patent: Apr. 28, 1987

[54] BOBBIN TRANSPORTING APPARATUS

[75] Inventor: Tsukasa Kawarabashi, Kyoto, Japan

[73] Assignee: Murata Kikai Kabushiki Kaisha, Kyoto, Japan

[21] Appl. No.: 584,820

[22] Filed: Feb. 29, 1984

[30] Foreign Application Priority Data

Mar. 3, 1983 [JP] Japan ..... 58-35416
Jul. 19, 1983 [JP] Japan ..... 58-131527

[51] Int. Cl.[4] ..... D01H 9/02; D01H 9/18; B65G 21/08

[52] U.S. Cl. ..... 57/274; 57/270; 57/276; 57/281; 198/690.2; 198/836; 198/860.3; 198/860.5; 242/35.5 A

[58] Field of Search ..... 57/270, 274, 276, 281; 198/860.3, 860.4, 860.5, 836, 688, 690.2; 242/35.5 R, 35.5 A

[56] References Cited

U.S. PATENT DOCUMENTS

| | | | |
|---|---|---|---|
| 2,249,588 | 7/1941 | Waddle | 198/860.3 X |
| 2,678,664 | 5/1954 | Bortner | 198/860.3 X |
| 3,195,298 | 7/1965 | Furst | 57/1 R |
| 3,245,214 | 4/1966 | Escursell-Prat | 57/270 |
| 3,328,948 | 7/1967 | DuBuis et al. | 57/270 |
| 3,410,406 | 11/1968 | Tsuda et al. | 57/281 X |
| 3,595,378 | 7/1971 | Kamisaka | 198/690.2 X |
| 3,768,241 | 10/1973 | Nelson et al. | 57/281 |
| 3,828,682 | 8/1974 | Klein | 57/281 X |
| 3,856,135 | 12/1974 | Hayakawa et al. | 198/860.5 |
| 3,878,936 | 4/1975 | Niggemyer | 198/860.5 X |
| 3,935,821 | 2/1976 | Maier et al. | 57/281 X |
| 4,046,248 | 9/1977 | Goffredo et al. | 198/860.3 X |
| 4,056,180 | 11/1977 | Gunti | 198/860.3 X |
| 4,170,293 | 10/1979 | Campbell | 198/860.4 |
| 4,181,228 | 1/1980 | Hashimoto et al. | 242/35.5 A X |
| 4,225,034 | 9/1980 | Sarovich | 198/836 X |
| 4,307,807 | 12/1981 | Oswald et al. | 57/270 X |
| 4,432,198 | 2/1984 | D'Agnolo | 57/276 |

*Primary Examiner*—John Petrakes
*Attorney, Agent, or Firm*—Spensley Horn Jubas & Lubitz

[57] ABSTRACT

An apparatus for transporting a bobbin between a winder and spinning frame. A curved transporting path is provided contiguously between a vertical transporting path and a horizontal transporting path, and a conveyor belt is disposed to extend along these paths. A cover which covers the bobbin transporting paths along a length thereof is provided.

12 Claims, 21 Drawing Figures

BOBBIN TRANSPORTING APPARATUS

BACKGROUND OF THE INVENTION

1. Field of the Invention

This invention relates to an apparatus for transporting a bobbin between a winder and spinning frame.

2. Prior Art

In a so-called fine spinning winder which includes a spinning frame and a winder directly interconnected to each other, a cop which has a yarn wound up on a bobbin by the spinning frame is supplied to the winder, at which the yarn is unwound therefrom onto a package and thus the cop is emptied into a bobbin. The thus emptied bobbin is then returned to the spinning frame again. As means for transporting such cops and bobbins, it is advantageous to employ a conveyor system, and thus various conveyor systems have been proposed so far which include, for example, a type in which cops are transported in a laid down condition on a conveyor, another type in which cops are fitted erectly on pegs of a conveyor for transportation thereof, and a further type in which empty bobbins are also placed similarly on a conveyor for transportation thereof.

Normally, fly wastes are afloat in the air in a spinning mill where bobbins are transported by means of a conveyor, and such fly wastes do not cause trouble while bobbins are being transported. But, for example, when a conveyor comes to stop because of power failure or because of suspension of operation of a spinning mill in the night-time and such stopping continues for a long time, fly wastes afloat in the air are accummulated on the conveyor and also on bobbins placed on the thus stopped conveyor.

Particularly in a place where a number of spinning frames are installed, fly wastes scattered from drafted fibers float in a large amount in the air. As a result, a large amount of fly wastes come to accummulate on a belt conveyor for transporting bobbins to be returned from a winder, and thus bobbins are supplied to a fine spinning unit with fly wastes adhered thereto. Accordingly, some fly wastes remain adhered to a yarn wound up onto a package, resulting in deterioration of quality of yarns obtained.

In the transporting means of the type in which bobbins are placed directly on a belt conveyor for transportation thereof, the conveyor which transport bobbins to a desired bobbin processing station is disposed to extend in a horizontal or inclined direction above a machine, that is, at a vertical position spaced above floor level by a particular distance which is at least greater than the stature of an operator in order to make effective use of a spacing.

In this case, bobbins must necessarily be lifted to the conveyor at such a height. To this end, an additional conveyor may be provided which circulates in a vertical plane, or otherwise, chuck devices adapted to individually grasp bobbins thereof may be provided which are arranged for movement along a vertically extending guide rail. Accordingly, the means in question requires a transporting device which circulates in a horizontal direction as mentioned above, and a device for transporting bobbins in a vertical direction, and hence it further requires provision of independent drive sources for such transporting devices. As a result, construction of the arrangement inevitably becomes complicated, and besides it is necessary to pay attention to smooth transportation also at a station at which bobbins are transferred from vertical to horizontal transportation.

SUMMARY OF THE INVENTION

An object of the present invention is to provide a bobbin transporting apparatus wherein bobbins are smoothly transported without any troubles when the bobbin is placed directly on a belt conveyor for transportation thereof.

The invention provides a cover device which can be easily incorporated in an existing spinning frame or winder without any modification of the latter.

Preferred embodiments of the present invention will now be described with reference to the accompanying drawings. According to the present invention, a bobbin transporting apparatus includes a cover which covers a bobbin transporting path along a length thereof so that a bobbin may be transported along the path which is covered therearound by the cover. Accordingly, fly wastes or other dust and the like floating in the air are prevented from adhering to bobbins during transportation and also from accummulating on the bobbin transporting path. As a result, fly wastes will not be mixed into or adhered to a layer of a yarn wound on a bobbin, thus assuring winding of a yarn of high quality onto a bobbin.

Further, the present invention provides a bobbin transporting apparatus which allows upward and horizontal transportation of articles such as bobbins or the like with a considerably simplified construction and which can be applied for transportation of various articles including transportation of cops and bobbins. According to the present invention, a curved transporting path is provided contiguously between a vertical transporting path and a horizontal transporting path, and a conveyor belt is disposed to extend successively along the vertical, the curved and the horizontal paths. Accordingly, only one drive source need be provided, and hence the article transporting apparatus of the invention is economical when compared with an arrangement in which a vertical transporting path and a horizontal transporting path are provided separately. Further, since a bobbin is not transferred intermediately of its transporting path, smooth transportation thereof is possible, and in addition where a cop having a layer of a yarn thereof is transferred, possible damage to a surface of the yarn layer arising from transfer thereof can be eliminated.

DETAILED DESCRIPTION OF THE INVENTION

Figure 1:
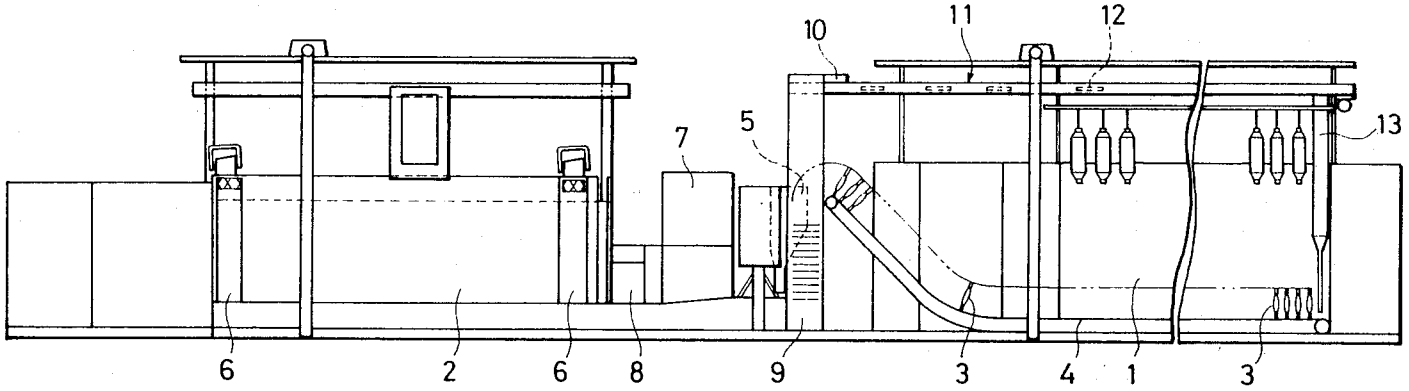
FIG. 1 is a diagrammatic representation of a fine spinning winder illustrating a first embodiment of a bobbin transporting apparatus according to the present invention.

Referring to FIG. 1 which is a diagrammatic representation showing one embodiment of a general construction of a fine spinning winder, a spinning frame 1 and a winder 2 are shown arranged in a juxtaposed relationship. A yarn is produced on the spinning frame 1 and is wound onto a cop 3. Then, the cop 3 is, for example, fitted onto and supported by a peg of a transport band 4 and is fed in a longitudinal direction and in front of the spinning frame 1 until it is thrown into a cop supply device 5. At the cop supply device 5, the cop 3 is fitted erectly on a cop transporting means at a standby position below such as, for example, a carrier member which is fed by means of a belt conveyor so that it is supplied to any of winding units 6 of the winder 2. A preparing device 7 is also provided which includes a yarn end seeking and readying device for releasing a tail end of a yarn of a cop produced on the spinning frame, a device for detecting presence or absence of a yarn on a bobbin, and so on.

Supply of cops to individual winding units of the winder 2 can be effected in various ways: in one type, cops are individually fitted on carrier members and supplied to winding stations of individual winding units; in another type, cops are laid down on and fed by a conveyor and supplied into cop storage magazines of individual winding units.

An empty bobbin after a yarn has been unwound therefrom or a bobbin on which a yarn remains thereon is fed to a bobbin processing device 8 by means of an empty bobbin transporting conveyor which extends along the winding units. Empty bobbins and bobbins having remaining yarns thereon are separated from each other by the bobbin processing device 8, and thus separated empty bobbins are then fed vertically upwardly by means of an empty bobbin lifting device 9 and are transferred onto a bobbin transporting apparatus 11 disposed above the spinning frame 1 by way of a chute 9 provided at the top of the empty bobbin lifting device 9 so that they are fed in a horizontal direction above the spinning frame 1. An empty bobbin 12 fed to an end of the spinning frame 1 is dropped into and stored in a chute 13 from which it is supplied and fitted in a timed relationship onto an empty peg on the transport band 4 below.

In this way, the spinning frame 1 and the winder 2 are interconnected directly to each other by means of a cop transporting path and a bobbin transporting path.

Details of the bobbin transporting apparatus 11 provided above the spinning frame 1 will now be described with reference to FIGS. 2 to 4.

Figure 2:
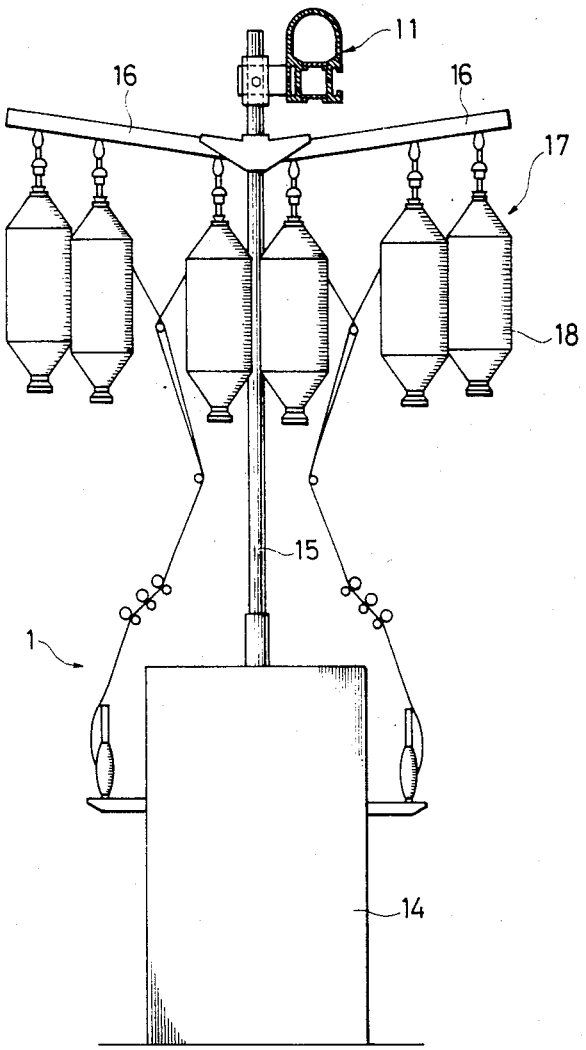
FIG. 2 is a side elevational view showing relative positions of a spinning frame and the bobbin transporting apparatus.

Referring to FIG. 2, the spinning frame 1 is shown, for example, as a ring spinning frame, and includes a body 14, a support rod 15 erected on the body 14, cross beams 16 supported on the support rod 15, and sliver bobbin holding devices 17 depending from the cross beams 16. The bobbin transporting apparatus 11 constructed in accordance with the present invention is arranged at a top portion of the support rod 15, that is, at a portion of the support rod 15 above the cross beams 16 on which sliver bobbins 18 are supported.

Figure 3:
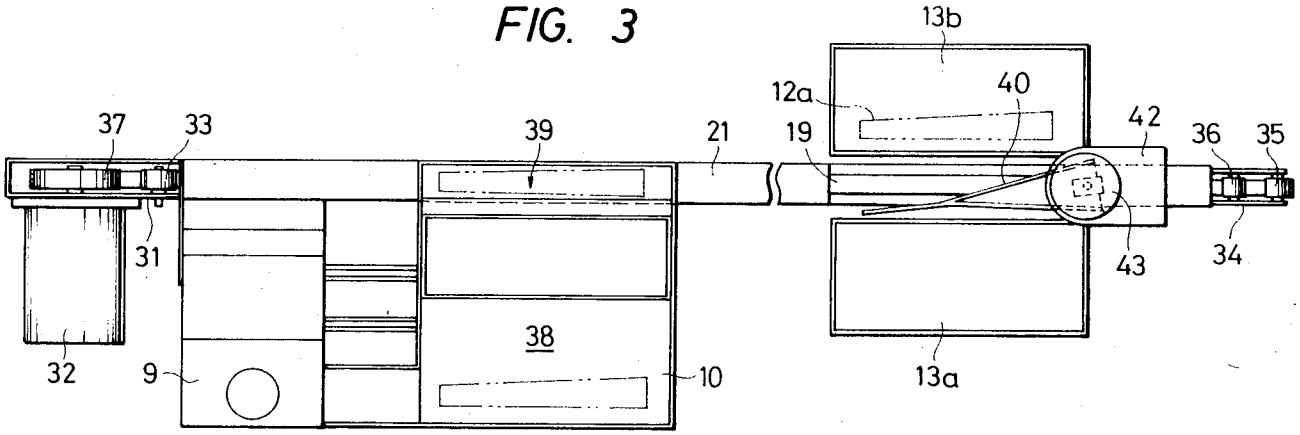
FIG. 3 is a plan view of the bobbin transporting apparatus.
Figure 4:
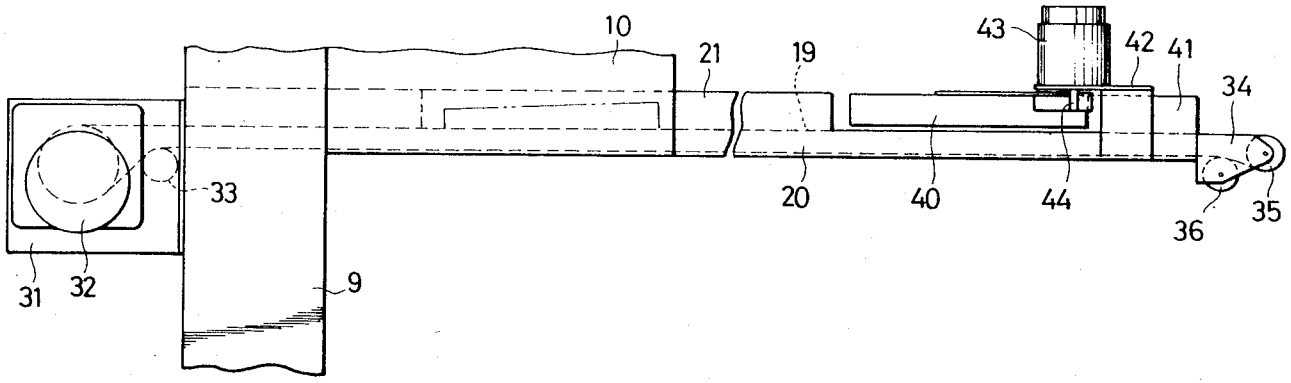
FIG. 4 is a front elevational view of the bobbin transporting apparatus.
Figure 5:
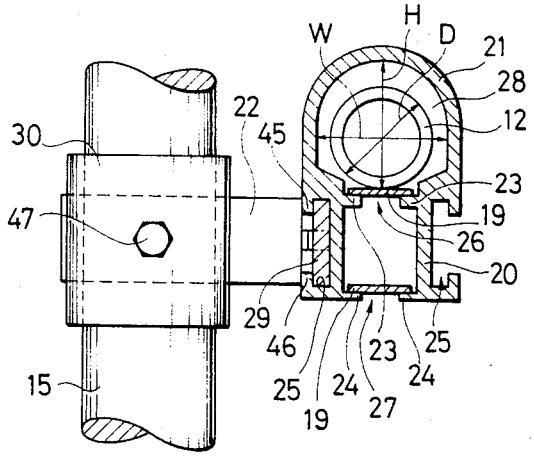
FIG. 5 is a cross sectional side elevational view showing a first embodiment of means for mounting the bobbin transporting apparatus.

Referring now to FIGS. 3 to 5, the bobbin transporting apparatus 11 includes a transporting conveyor 19, a support member 20 on which the conveyor 19 is supported, a cover 21 which covers over the conveyor 19, a mounting member 22 for mounting the transporting apparatus on the support rod, and so on.

As shown in FIG. 5, the support member 20 has guide sections 23 and 24 for a conveyor belt, and has recesses 25 formed in opposite sides thereof and adapted to be engaged by the mounting member 22 to mount the support member 20 on the mounting member 22. The cover 21 may be either formed integral with or fixedly mounted on the support member 20. Cut away portions 26 and 27 for passing the conveyor belt are formed between the opposite belt guide sections 23 and 24, respectively. The cover 21 has a substantially arcuate cross section, and a passage spacing 28 defined by the cover 21 is designed to have a cross sectional area which is at least greater than a cross sectional area of an empty bobbin 12 such that is does not allow transportion of two empty bobbins in side by side relationship therein and it prevents a bobbin from being clamped between another bobbin and an inner wall face of the cover 21.

A block 29 is inserted in one of the grooves in the opposite sides of the support member 20, and the mounting member 22 is screwed into the block 29 and is secured to the support rod 15 of the spinning frame by means of a fastening metal member 30.

Adjacent an end of the transporting path, that is, adjacent the end adjacent the winder, a motor 32 and a guide roller 33 are supported on a bracket 31 secured to the support member 20. Meanwhile, adjacent the opposite end of the transporting path, that is, adjacent the end adjacent the spinning frame, a pulley 35 and a guide pulley 36 are supported for rotation on a bracket 34 also secured to the support member 20. The belt 19 extends between a pulley 37 on a shaft of the motor 32 and the pulley 35.

The bobbin chute 10 which is connected to the bobbin lifting device 9 has an inclined face 38 which extends through an opening 39 in the cover 21 to a position just above the conveyor.

A movable guide 40 for separating bobbins and a pair of chutes 13*a* and 13*b* are provided adjacent the other end of the conveyor 19 in order to supply bobbins to spindles at opposite sides of the spinning frame as shown in FIG. 2. In particular, a plate 42 is supported on the support member 20 by means of a bracket 41, and a rotary solenoid 43 is placed on the plate 42 with its shaft 44 directed in a vertical direction. A guide plate 40 is secured to the shaft 44 of the solenoid 43 so that the guide plate 40 may assume two positions in response to energization and deenergization of the rotary solenoid 43. In the case of the arrangement of FIG. 3, an empty bobbin 12*a* is guided by the guide plate 40 so that it is discharged into the chute 13*b*.

Now, means for mounting the bobbin transporting apparatus to the support rod will be described. Referring to FIG. 5, the block member 29 is inserted for sliding motion in a direction perpendicular to the plane of the drawing in one of the recessed grooves 25 formed in opposite sides of the support member 20, as described hereinabove. Then, a threaded portion at an end of the mounting member 22 is screwed into a portion of the block 29 adjacent the support rod 15 of the spinning frame, and projections 45 and 46 of the support member 20 are clamped between the block 29 and the mounting member 22 whereafter the mounting member 22 is inserted into the fastening metal member 30 and secured to the support rod 15 by means of a fastening screw 47. The fastening metal member 30 may be a similar part to that employed in another embodiment which will be described hereinafter. While in the embodiment of FIG. 5 the cover 21 and the support member 20 are shown as an integrated single component, it is also possible that the two may be formed as two separate parts and the cover 21 may be made of a transparent synthetic resin material and supported for pivotal opening and closing motion on the support member 20.

Figure 6:
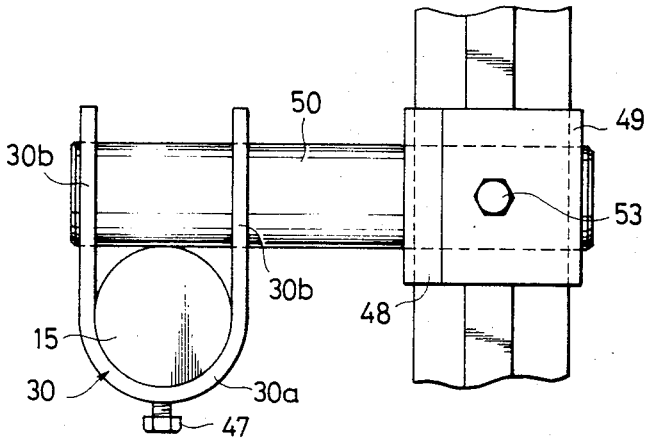
FIG. 6 is a plan view showing a second embodiment of means for mounting the bobbin transporting apparatus.
Figure 7:
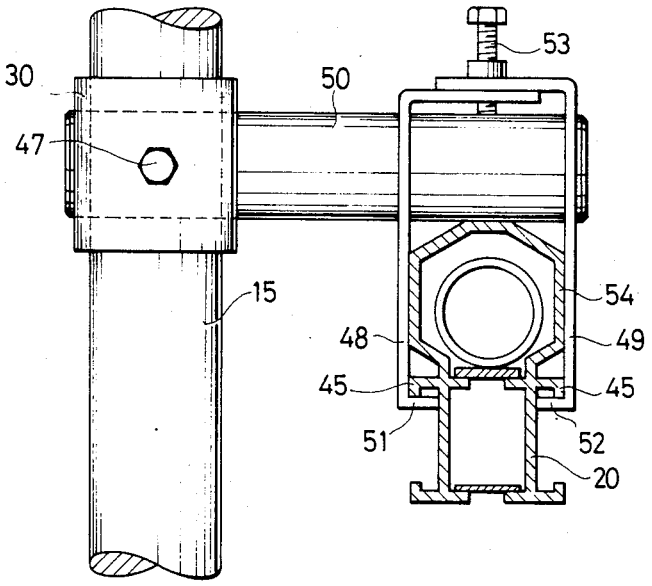
FIG. 7 is a side elevational view of the transporting means of FIG. 6.

Referring to FIGS. 6 and 7 which illustrate a second embodiment, substantially channel-shaped hanger metal members 48 and 49 are fitted on a rod 50 and then projections 45 on opposite sides of the conveyor support member 20 are placed on lower bent sections 51 and 52 of the hanger metal members 48 and 49, respectively, whereafter the hanger metal members 48 and 49 are secured in position on the support rod 15 by means of the metal member 30 cooperating with a screw 47. As shown in FIG. 6, the metal member 30 is made of a steel plate of a substantially U-shape in plan having an arcuate portion 30*a* having a shape supplementary to the circular shape of the support rod 15 and opposing flat portions 30*b* contiguous to the arcuate portion 30*a*. Rod receiving holes are perforated in the flat portions 30*b* of the metal member 30. Thus, the transporting apparatus 11 is secured at a suitable height to the support rod 15 by a suitable means: for example, the screw 47 is screwed against a face of the support rod 15 to press the rod 50 against the support rod 15 so as to by supported by the latter; or the screw 47 extending through the metal member 30 is screwed into a threaded hole formed in the support rod 15; and so on. It is to be noted that the fastening metal member 30 for securing the rod 50 to the support rod 15 may be applied in a quite same manner to the arrangement of FIG. 5. It is also to be noted that, while a cover 54 is shown having a polygonal configuration, it has a similar function to that of the cover 21.

Figure 8:
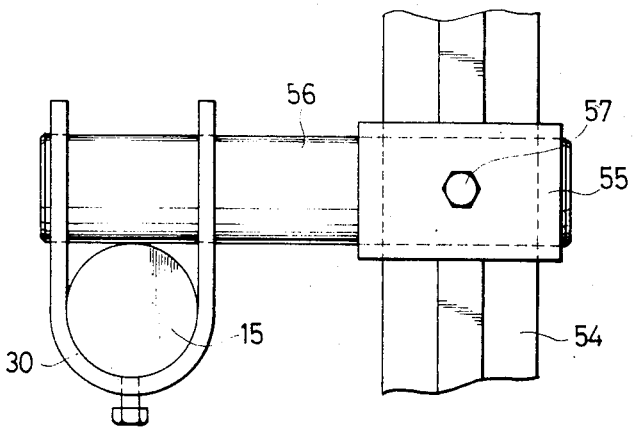
FIGS. 8 and 9 are a plan view and a side elevational view, respectively, showing a third embodiment of means for mounting the bobbin transporting apparatus.
Figure 9:
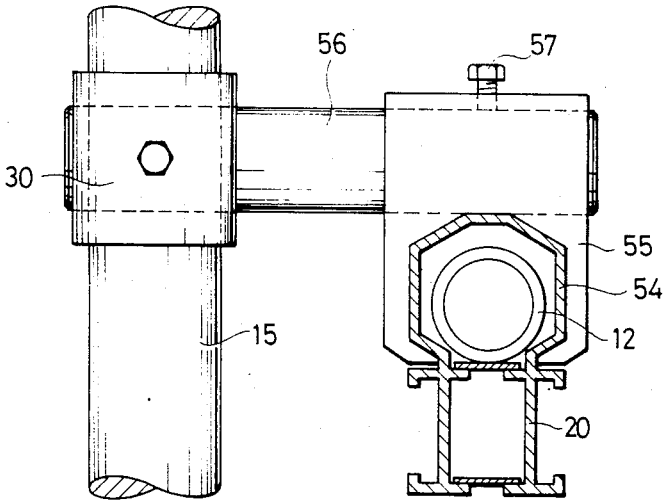

Referring to FIGS. 8 and 9 which illustrate a third embodiment, the cover 54 for the transporting apparatus 11 is hung on and supported by means of a support metal member 55 which has a shape complementary to the shape of the cover 54. The support metal member 55 is secured to a rod 56 by means of a screw 57, and the rod 56 is in turn secured to the support rod 15 by means of a metal member 30 similar to the metal member as described hereinabove.

Figure 10:
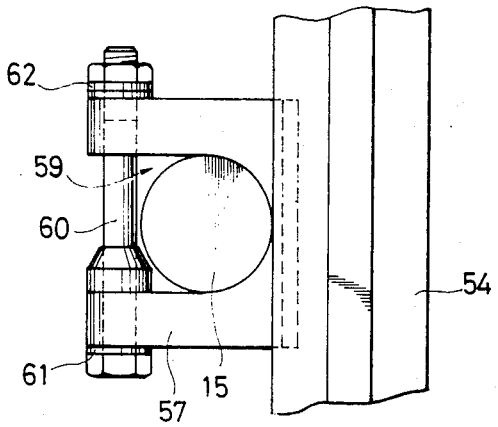
FIGS. 10 and 11 are a plan view and a side elevational view, respectively, showing a fifth embodiment of means for mounting the bobbin transporting apparatus.
Figure 11:
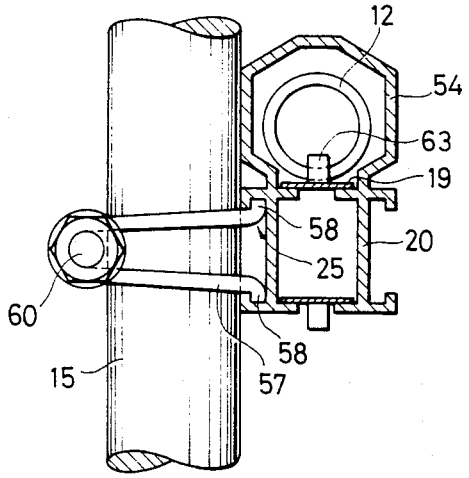

FIGS. 10 and 11 illustrate a fourth embodiment of the invention. A metal member 57 in the form of a spring plate has opposite ends 58 thereof engaged in one of the recessed grooves 25 formed in opposite sides of the support member 20 and is securely mounted directly on the support rod 15. The metal member 57 has a U-shaped recess 59 formed therein for receiving the support rod therein and is secured to the support rod 15 by means of a bolt 60 cooperating with washers 61 and 62. Further, the conveyor belt 19 for transportation of bobbins is constructed as a conveyor belt of the type which has pins 63 implanted thereto.

Figure 12:
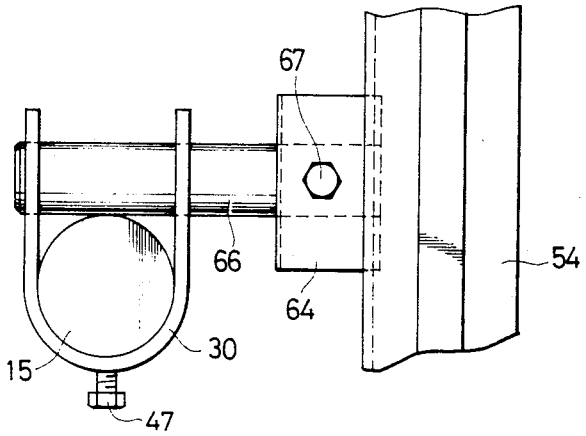
FIGS. 12 and 13 are a plan view and a side elevational view, respectively, showing a fifth embodiment of means for mounting the bobbin transporting apparatus.
Figure 13:
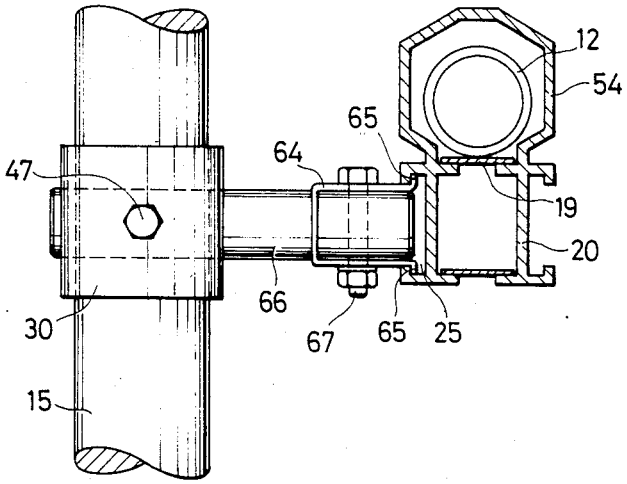

FIGS. 12 and 13 illustrate a fifth embodiment of the invention. Bent portions 65 formed at opposite ends of a spring plate 64 are engaged in one of the recessed grooves 25 formed in opposite sides of the support member 20, and the spring plate 64 is fitted on a rod 66 and secured thereto by means of a bolt 67 extending through the spring plate 64 and the rod 66. The rod 66 is secured to the support rod 15 by means of the metal member 30.

Thus, as shown in FIGS. 1 and 2, an empty bobbin discharged from the winder 2 is fed to the lifting device 9 by the conveyor and is then fed upwardly by the lifting device 9 whereafter it is transferred by way of the chute 10 provided at the top of the lifting device 9 onto the conveyor belt 19 of the transporting apparatus 11 disposed to extend above and in the longitudinal direction of the spinning frame 1 so that it is fed to an end of the spinning frame 1. In this case, the bobbin 12 is placed, during transportation thereof, on the conveyor 19 such that the axis thereof coincides with the direction of movement of the conveyor, and since the bobbin 12 is covered by the cover 21 therearound, it will not drop from the conveyor 19. Further, since a cross sectional area of the bobbin path 28 defined by the cover 21 is rather greater than a cross sectional area of the bobbin taken perpendicularly to the axis thereof, or in other words, both the width W and the height H of the bobbin path 28 are greater than the maximum diameter D of the empty bobbin, two or more bobbins are not allowed to be fed in a juxtaposed relationship along the path 28, thereby preventing jamming of bobbins in the path 28. The bobbin 12 transported on the conveyor 19 in this way is then dropped alternatively into the bobbin chute 13*a* or 13*b* adjacent the end of the spinning frame by means of the movable guide plate 40 as shown in FIG. 3, and then after passing the bobbin storing and releasing device 13 of FIG. 1, it is fitted on one of the pegs on the transport band 4 of the spinning frame.

It is to be noted that it is naturally possible to provide such a cover 21 or 54 of the bobbin transporting apparatus to a cop supplying path in a winder or to a transporting path for transporting an empty bobbin and a bobbin with a remaining yarn discharged from the winder in order to prevent fly wastes from adhering to a surface of a yarn layer of the bobbin. Further, if a cover extending along the entire length of the bobbin transporting path may be arranged for partial opening and closing motion at an intermediate portion thereof so as to allow removal from the path of bobbins which have been jammed in the path.

Now, other embodiments of the present invention which can be well applied for transportation of empty bobbins will be described with reference to the accompanying drawings.

Figure 14:
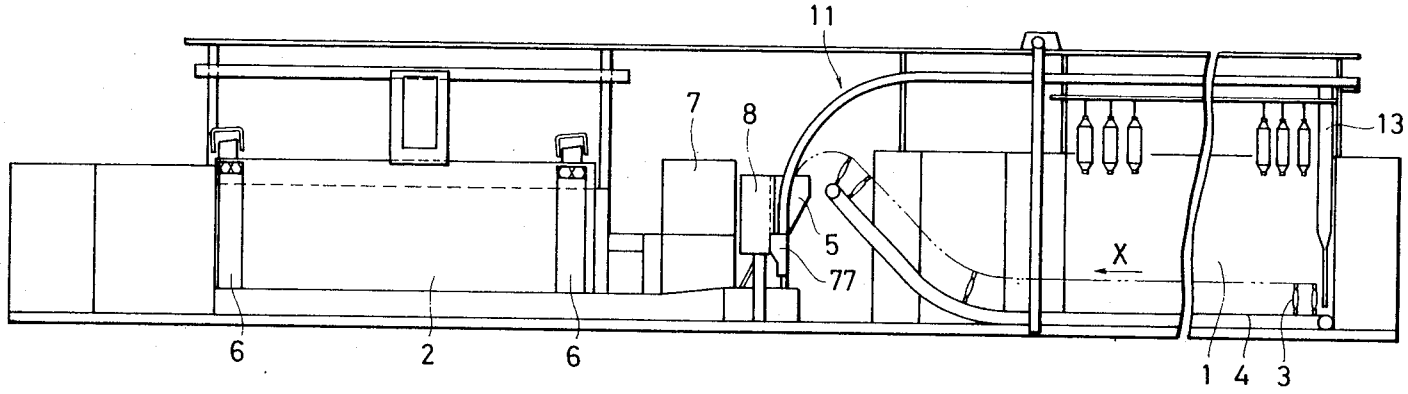
FIG. 14 is a diagrammatic representation illustrating another embodiment in which an apparatus according to the present invention is applied to a fine spinning winder.

Referring to FIG. 14 which is a diagrammatic representation showing a general construction of a fine spinning winder which includes a spinning frame and a winder directly connected to each other, a spinning frame 1 and a winder 2 are shown arranged in a juxtaposed relationship. A yarn is produced on the spinning frame 1 and is wound onto a cop 3. Then, the cop 3 is, for example, fitted onto and supported by a peg of a transport band 4 which circulates in a longitudinal direction in front of the spinning frame 1. The cop 3 is fed in a direction indicated by an arrow X and is then thrown into a cop supply device 5. At the cop supply device 5, the cop 3 is fitted erectly on a cop transporting means at a standby position below such as, for example, a carrier member which has a disk portion and a projection provided at the center of the disk portion and adapted to be fitted into a bobbin and which is fed by means of a belt conveyor so that it is supplied to any of winding units 6 of the winder 2. A preparing device 7 is also provided which includes a yarn end seeking and readying device for releasing a tail end of a bunch winding of a yarn of a cop produced on the spinning frame, a device for detecting presence or absence of a yarn on a bobbin, and so on.

An empty bobbin after a yarn has been unwound therefrom at each winding unit of the winder or a bobbin on which a yarn remains thereon is fed by means of a bobbin transporting conveyor extending along the winding units while it is held fitted on a carrier member on the conveyor.

As bobbins arrive at a bobbin processing device 8, they are separated into empty bobbins and bobbins having remaining yarns thereon. Thus separated empty bobbins are pulled off the carrier members and transferred onto a bobbin transporting apparatus 11, which will be described hereinafter, by which means they are thereafter fed in a horizontal direction above the spinning frame. An empty bobbin thus fed to an end of the spinning frame 1 is then transferred, by way of a chute 13 in a timed relationship onto the transport band 4 below or else into an empty bobbin storage box below so as to be contained thereby.

In this way, the spinning frame 1 and the winder 2 are interconnected directly to each other by means of the cop transporting path and the bobbin transporting path.

The second embodiment of bobbin transporting apparatus will now be described with reference to FIGS. 14 and 15.

The bobbin transporting apparatus 11 has a vertical transporting path 70, a curved transporting path 71 and a horizontal transporting path 72 and includes along these transporting paths a continuous conveyor support member 73 and a conveyor belt 74 which extends through and travels within the support member 73. A conveyor drive device 75 is provided adjacent an end of the horizontal transporting path 72. A bobbin throw-in station is provided at a portion of the vertical transporting path 70.

The conveyor support member 73 which extends along the entire transporting paths may be constituted, for example, from a molded member having a cross section of a shape such as shown in FIG. 5.

Figure 15:
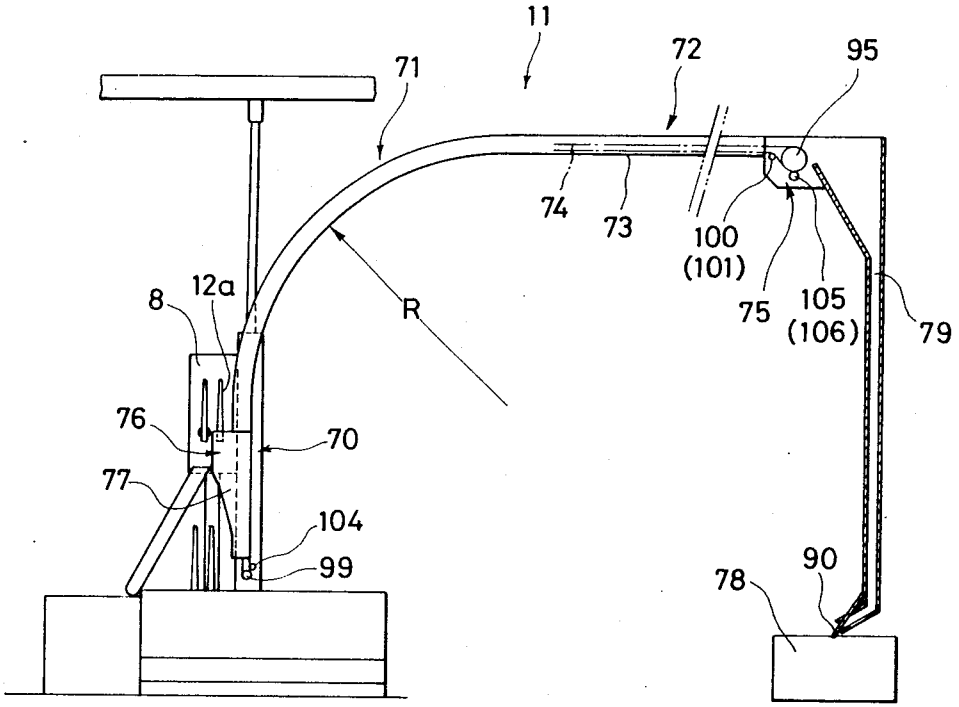
FIG. 15 is a diagrammatic representation of part of the embodiment of FIG. 14.

The belt support member 73 having such a construction as shown in FIG. 5 constitutes the vertical transporting path 70, the curved transporting path 71 and the horizontal transporting path 72, as shown in FIG. 15, and is secured to suitable support rods.

Meanwhile, at the bobbin throw-in station 76 of the bobbin transporting apparatus shown in FIG. 15, the support rod 73 is secured to extend vertically and the cover 21 is partially cut away so as to receive a bobbin chute 77 therein. Thus, as a bobbin 12*a* which has been brought to a lifted position by the bobbin processing device 8 is thrown into the chute 77, it is placed onto one of the pins provided on a surface of the conveyor which is directed in a vertical direction.

It is to be noted that, in the case of the arrangement of FIG. 15, the horizontal transporting path 72 is contiguous at an end thereof to a chute 79 which allows a bobbin to be dropped therefrom into a bobbin storing box 78 below. Reference numeral 90 denotes a rubber plate for moderating a shock by a bobbin.

Figure 16:
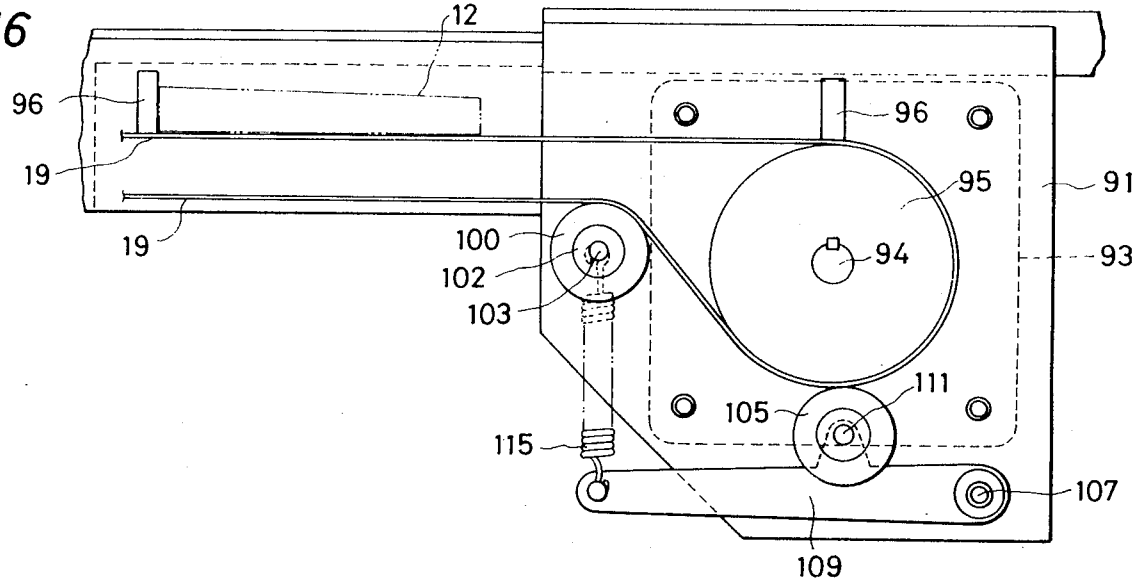
FIG. 16 is a front elevational view showing a drive device for a conveyor, belt of the bobbin transporting apparatus.
Figure 17:
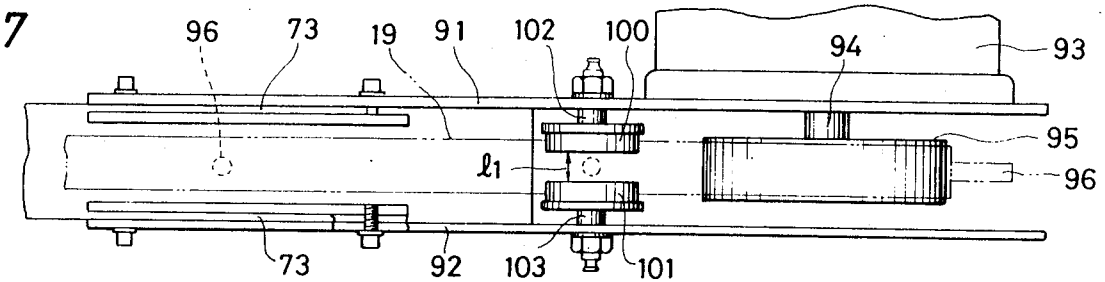
FIG. 17 is a plan view of the drive device of FIG. 16.
Figure 18:
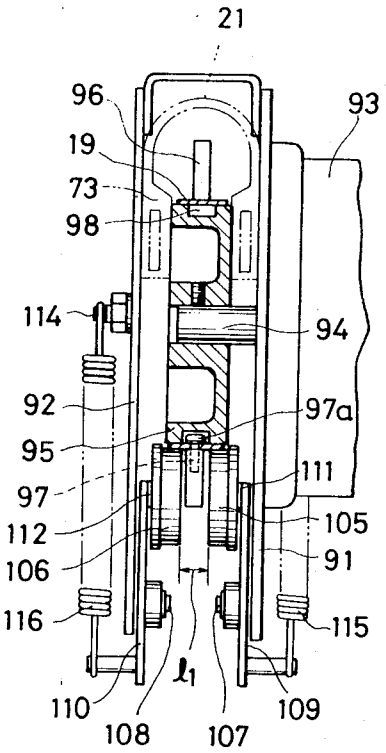
FIG. 18 is a side elevational view of the drive device of FIG. 17.

FIGS. 16 to 18 illustrate a drive device for the conveyor belt 19 which extends through the entire transporting paths.

A pair of brackets 91 and 92 are secured to opposite sides of the support member 73, and a motor 93 is secured to the bracket 91 on one side. A drive pulley 95 is secured to a shaft 94 of the motor 93. An annular recessed groove 98 is formed in the center of an outer peripheral face of the pulley 95 such that it allows passage of a head 97*a* of a screw 97 by which means a pin 96 is secured to the belt 19. The endless belt 19 extending around the pulley 95 also extends around a follower pulley 99, as shown in FIG. 15.

Tension pulleys 100 and 101 for the belt 19 are mounted for rotation on shafts 102 and 103 supported on the brackets 91 and 92, respectively, and are engaged under pressure with the belt 19 adjacent opposite sides thereof to provide suitable tension to the belt 19. The distance l1 between the tension pulleys 100 and 101 is designed to be of a size to allow passage of a pin 96 on the belt without any trouble. Pulleys 104 similar to the tension pulleys may be provided adjacent the other end of the travel of the belt, as shown in FIG. 15.

The belt 19 extending along the entire transporting paths 70, 71, and 72 circulates along the curved support member as shown in FIGS. 14 and 15, and hence at the curved portion 71, a load is applied in a direction to press the belt against the belt guide faces (24 and 24 of FIG. 5) of the support member 73. As a result, a slip may possibly occur between the drive pulley 95 and the belt 19, and in order to eliminate such a possible slip, nip rollers 105 and 106 are provided which press the belt against the drive pulley 95.

In particular, the nip rollers 105 and 106 are supported for rotation at intermediate portions of levers 109 and 110 which are in turn supported for rotation on shafts 107 and 108 secured to the brackets 91 and 92, respectively. Tension springs 115 and 116 extend between ends of the levers 109 and 110 and pins 113 and 114 secured to the brackets 91 and 92, respectively. Accordingly, the nip rollers 105 and 106 are contacted under pressure with the belt 19 on the drive pulley 95 by respective spring forces.

It is to be noted that pressure contact positions of the belt by the nip rollers 105 and 106 are spaced a particular distance from opposite sides of the belt 19, and the nip rollers 105 and 106 are also spaced to define a gap of the distance l1 which allows passage of a pin on the belt.

It is further to be noted that the nip rollers 105 and 106 may otherwise be integrated into a single roller. In particular, if a large diameter roller, for example, a roller which has a radius greater than the length of a pin 96 is used and an annular recessed groove which is sufficiently deep to allow passage of a pin is formed in the center of an outer periphery of the roller, similar effects to those of the nip rollers 105 and 106 can possibly be exhibited.

Accordingly, a possible slip of the belt 19 around the drive pulley 95 which might be caused by a resistance at the curved portion of the belt 19 can be prevented by the nip rollers 105 and 106 which press the belt 19 against the surface of the drive pulley 95.

Figure 19:
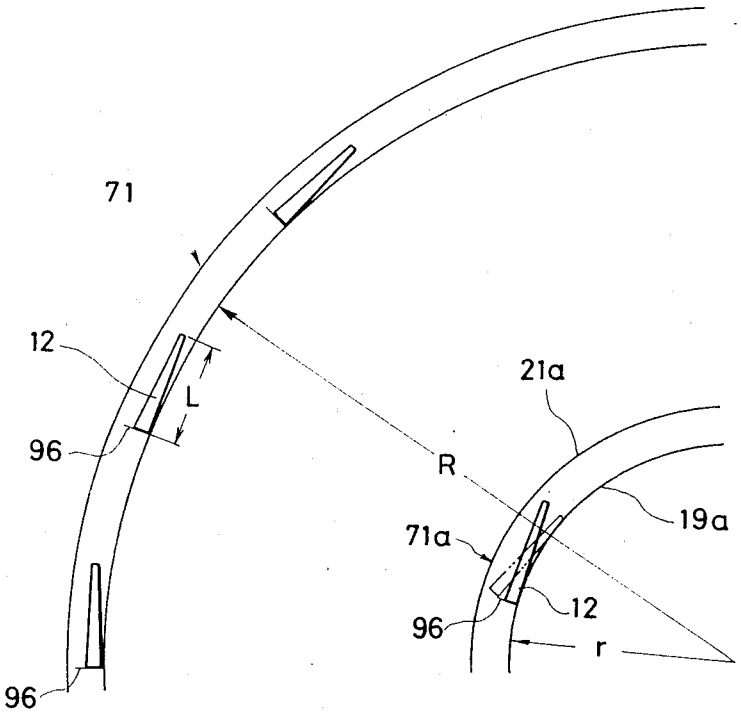
FIG. 19 is an illustration showing a radius of curvature of a curved transporting path.

FIG. 19 illustrates a relationship between an empty bobbin 12 at the curved portion 71 of the transporting device 11 and a radius of curvature of the curved portion. In case the radius r as at a curved portion 71*a* is small compared with the length L of a bobbin, the bobbin assumes an inclined position at the curved portion so that it may possibly come off the pin 96. As a result, even if the cover 21*a* is provided there, there still remains the possibility that the bobbin may be clamped or jammed between surfaces of the cover 21*a* and the belt 19*a*.

Further, the degree of curvature of the belt is steep, and hence the bending stress of the belt is large, resulting in the possibility of reduction of the life of the belt. In consideration of these circumstances, the radius of curvature R of the curved portion 71 is determined to be a suitable value depending upon an available spacing, the length of a bobbin, the life of a belt, the height of the horizontal feeding section, and so on.

For example, where the height of the horizontal transporting path 72 is 2 m and the length of a bobbin to be transferred is 21 cm, about 1 m is suitable for the radius of curvature R.

Figure 21:
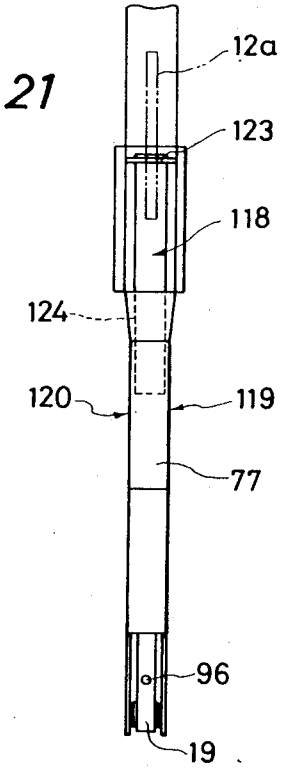
FIG. 21 is a front elevational view of the bobbin chute of FIG. 20.
Figure 20:
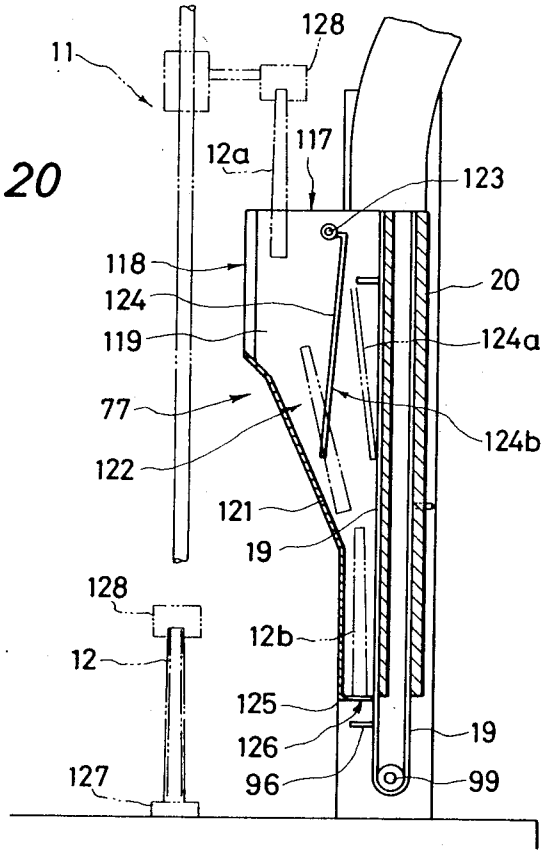
FIG. 20 is a side elevational cross sectional view showing the construction of a bobbin chute.

FIGS. 20 and 21 illustrate an example of a bobbin throw-in station of the vertical transporting path 70. The cover portion 21 of the support member 20 is partly cut away and a guide chute 77 is secured to the support member 20 through the cut away portion. The guide chute 77 is open at the top portion 117 and at a front portion 118 thereof so as to allow a bobbin to be admitted into the guide chute 77, and a bobbin path 122 is defined by opposite side walls 119 and 120 and a bottom wall 121 of the guide chute 77 and the conveyor belt 19.

A flapper 124 is supported for pivotal rocking motion on a shaft 123 which is fixed to and extends between the side walls 119 and 120 of the guide chute 77. Normally the flapper 124 is in an inclined position as shown in full lines in FIG. 20 due to its own weight. A lower plate 125 of the chute 77 provides a bobbin receiving face which has a gap 126 formed therein through which a pin 96 of the belt can pass.

Accordingly, an empty bobbin 12 fitted on a carrier member 127 on the bobbin transporting path is pulled off the carrier member 127 at the bobbin processing device 7 by means of a chuck 128 which is mounted for lifting and pivotal motion. The bobbin 12 is thus moved to a phantom position 12*a* at which it is released from the grasped condition and is dropped into the chute 77 until it is received on the receiving face 125 of the chute 77 while it pushes the flapper 124 to its phantom position 124*a*. In this condition, as the conveyor belt 19 circulates, a pin 96 on the belt is engaged with the bottom of the bobbin 12*b* to lift it along the vertical transporting path. The bobbin 12*b* is thereafter transported along the curved transporting path 71 and then along the horizontal path 72. It is to be noted here that, even if the bobbin tends to be inclined leftwardly as in FIG. 20 when it is lifted from the bobbin receiving face 125 within the chute 77, since it is lifted while being guided by a side face 124*b* of the flapper 124, it is transported in the vertical direction without falling down.

It is to be noted that reference numeral 99 designates a follower pulley of the conveyor belt 19, and it is also possible to urge a tension roller 100 to the belt 19 as in the case of FIG. 15.

In the bobbin transporting apparatus having such a construction as described above, if a bobbin is thrown and dropped into the chute 77 at the bobbin throw-in station 76 as shown in FIGS. 14 and 15, then it is engaged at a tail portion thereof by a pin 96 on the circulating conveyor belt 19 and is thus fed thereby. As a result, the bobbin is transported successively along the vertical path 70, the curved path 71 and the horizontal path 72, thus without being transferred to any other conveyor or transporting means in the meantime. The bobbin is finally supplied at the end of the horizontal path either onto a peg on the transport band of the spinning frame or into a bobbin storage box so as to be stored therein.

It is to be noted that, while in the embodiments described above an empty bobbin is transported to the spinning frame, it is otherwise possible to collect bobbins at the winder, and if the spinning frame of FIG. 14 has fine spinning spindles disposed in back to back relationship, then it is also possible to provide a movable guide for separating bobbins adjacent the end of the horizontal transporting path so that bobbins may be thrown into chutes corresponding to the individual spindle rows.

Furthermore, the bobbin transporting apparatus of the present invention may be utilized not only for the fine spinning frame mentioned above, but for transporting bobbins ejected from a winder to a store box, which is transported to a spinning machine shop, or for transporting bobbins ejected from a winder to a spinning frame which is located far away from the winder and is interconnected by a conveyor with the winder.

What is claimed is:

1. A bobbin transporting apparatus in which a spinning frame and a winder are interconnected directly to each other by means of a cop transporting path and a bobbin transporting path, comprising:

a transporting conveyor belt for conveying said bobbins in a substantially vertical direction along a first portion of said bobbin transporting path and in a substantially horizontal direction along a second portion of said bobbin transporting path;

a support member on which said conveyor belt is supported;

a cover which covers over said conveyor belt;

a support rod; and a mounting member for mounting said support member on said support rod, said support member having two guide sections for guiding said conveyor belt, and having recessed grooves formed in opposite sides thereof and adapted to be engaged by said mounting member to mount said support member on said mounting member.

2. A bobbin transporting apparatus according to claim 1, wherein said cover has a substantially arcuate cross section defining a passage having a diameter greater than the maximum diameter of an empty bobbin.

3. A bobbin transporting apparatus according to claim 1, wherein said cover has a polygonal cross section defining a passage having a cross sectional area greater than the maximum cross sectional area of an empty bobbin.

4. A bobbin transporting apparatus according to claim 1, wherein said mounting member further comprises a block member slidably inserted in one of said recessed grooves, said block member being secured to said support rod by means of a fastening screw.

5. A bobbin transporting apparatus according to claim 1, wherein said mounting member further comprises a pair of substantially channel-shaped hanger metal members which are fitted on said support rod, each of said metal members having a lower bent section, said lower bent section being configured to fit in one of said recessed grooves.

6. A bobbin transporting apparatus according to claim 1, wherein said mounting member further comprises a support metal member having an interior opening shaped to complement the exterior shape of said cover and to thereby hang on to said cover.

7. A bobbin transporting apparatus according to claim 1, wherein said mounting member further comprises a metal member in the form of a spring plate which has opposite ends, each of said ends being engaged in one of said recessed grooves of said support member, said metal member being securely mounted on said support rod.

8. A bobbin transporting apparatus according to claim 1, wherein said mounting member further comprises a substantially u-shaped spring plate having bent portions formed at opposite ends thereof, each of said bent portions being engaged in one of said recessed grooves of said support member, said spring plate being secured to said support rod.

9. A bobbin transporting apparatus in which a spinning frame and a winder are interconnected directly to each other by means of a cop transporting path and a bobbin transporting path, comprising:

a unitary, continuous conveyor belt for conveying said bobbins in a substantially vertical direction along a first portion of said path and in a substantially horizontal direction along a second portion of said path;

a continuous conveyor support member, said conveyor belt extending through and traveling within said support member;

a conveyor drive device provided adjacent to said belt, said conveyor drive device including:

a motor secured to said support member;

a drive pulley driven by said motor around which said belt is extended; and at least one tension pulley engaged under pressure with said belt, said belt further including at least one pin extending therefrom upon which said bobbin may be supported; and nip rollers which are contacted under pressure with said belt and which are spaced to allow passage of said pin therethrough.

10. A bobbin transporting apparatus in which a spinning frame and a winder are interconnected directly to each other by means of a cop transporting path and a bobbin transporting path comprising:

a unitary, continuous conveyor belt for conveying said bobbins in a substantially vertical direction along a first portion of said path and in a substantially horizontal direction along a second portion of said path;

a continuous conveyor support member, said conveyor belt extending through and traveling within said support member;

a conveyor drive device provided adjacent to said belt, said conveyor drive device including:

a motor secured to said support member;

a drive pulley driven by said motor around which said belt is extended; and at least one tension pulley engaged under pressure with said belt, said belt further including at least one pin extending therefrom upon which said bobbin may be supported; and a nip roller having a radius greater than the length of said pin and having an annular recessed groove to allow passage of said pin in the center of an outer periphery thereof, said nip roller contacted under pressure with said belt.

11. A bobbin transporting apparatus in which a spinning frame and a winder are interconnected directly to each other by means of a cop transporting path and a bobbin transporting path, comprising:

a unitary, continuous conveyor belt for conveying said bobbins in a substantially vertical direction along a first portion of said path and in a substantially horizontal direction along a second portion of said path, a continuous conveyor support member, said conveyor belt extending through and traveling within said support member;

at least one pin fixed on said conveyor belt; and a bobbin throw-in station adjacent said first portion of said path, said station including a guide chute which is secured to said support member, said guide chute having a front portion configured so as to allow a bobbin to be admitted into said guide chute, and a bobbin receiving gap formed by a lower plate of said chute and said conveyor belt and being arranged so as to position said bobbin on said pin fixed on said conveyor belt.

12. The bobbin transporting apparatus according to claim 11, wherein a flapper is provided within said guide chute, said flapper being supported for pivotal rocking moliser on a shafe-lo guide a bobbin into said bobbin receiving gap.

* * * * *